US011571708B2

(12) United States Patent
Huang et al.

(10) Patent No.: US 11,571,708 B2
(45) Date of Patent: Feb. 7, 2023

(54) METHOD FOR MANUFACTURING GOLF BALL

(71) Applicant: FOREMOST GOLF MFG. LTD., Taipei (TW)

(72) Inventors: Chia-Sheng Huang, Taipei (TW); Chi-Ling Lin, Changhua County (TW); Chia-Cheng Wu, Changhua County (TW); Ching-Hsiang Liu, Yunlin County (TW)

(73) Assignee: FOREMOST GOLF MFG. LTD., Taipei (TW)

( * ) Notice: Subject to any disclaimer, the term of this patent is extended or adjusted under 35 U.S.C. 154(b) by 0 days.

(21) Appl. No.: 17/363,008

(22) Filed: Jun. 30, 2021

(65) Prior Publication Data

US 2022/0212227 A1 Jul. 7, 2022

(30) Foreign Application Priority Data

Jan. 4, 2021 (TW) ..... 110100135

(51) Int. Cl.

| | |
|---|---|
| ***B05D 1/02*** | (2006.01) |
| ***B05D 1/00*** | (2006.01) |
| ***A63B 45/02*** | (2006.01) |
| ***B05B 13/02*** | (2006.01) |
| *A63B 37/00* | (2006.01) |

(52) U.S. Cl.

CPC ..... *B05D 1/002* (2013.01); *A63B 45/02* (2013.01); *B05B 13/0228* (2013.01); *B05D 1/02* (2013.01); *A63B 37/0022* (2013.01)

(58) Field of Classification Search

CPC ..... B05D 1/02; A63B 45/02

See application file for complete search history.

(56) References Cited

U.S. PATENT DOCUMENTS

| | | | | |
|---|---|---|---|---|
| 4,269,355 | A * | 5/1981 | Geberth, Jr. | B05B 15/50 239/107 |
| 2010/0298069 | A1* | 11/2010 | Goodwin | A63B 37/0022 473/378 |
| 2011/0039638 | A1* | 2/2011 | Koleoglou | A63B 43/008 473/378 |
| 2014/0066229 | A1* | 3/2014 | Kuntimaddi | B05B 12/20 473/378 |
| 2017/0182366 | A1* | 6/2017 | Shinohara | A63B 37/0075 |

FOREIGN PATENT DOCUMENTS

| | | |
|---|---|---|
| CN | 1350874 A | 5/2002 |
| TW | M479149 U | 6/2014 |
| TW | I445580 B | 7/2014 |

* cited by examiner

*Primary Examiner* — Nathan T Leong

(74) *Attorney, Agent, or Firm* — Li & Cai Intellectual Property Office

(57) ABSTRACT

A method for manufacturing a golf ball having a non-uniform dot pattern is provided. Firstly, a semi-finished product of a golf ball is provided, which includes a ball body and a base layer covering an outer surface of the ball body. After that, the semi-finished product of the golf ball is rotated at a predetermined rotation speed, and a color paint is applied to the semi-finished product of the golf ball in a spraying manner from each of an upper position and a lower position.

4 Claims, 9 Drawing Sheets

METHOD FOR MANUFACTURING GOLF BALL

CROSS-REFERENCE TO RELATED PATENT APPLICATION

This application claims the benefit of priority to Taiwan Patent Application No. 110100135, filed on Jan. 4, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a method for manufacturing an appearance pattern, and more particularly to a method for manufacturing a golf ball having a non-uniform dot pattern.

BACKGROUND OF THE DISCLOSURE

With the increase of living standards and the emphasis on outdoor recreational activities, more and more people have taken an interest in playing golf, including men and women of different demographics. That is to say, male and female golf players of different professions or different ages can play together for purposes of competition and interaction. Such is the appeal of golf.

A golf ball generally has a one-piece structure or a number of layers including at least one core and at least one cover enclosing the cores. Generally, one or more layers of a coating material and/or one or more transparent coated layers are applied to an outer surface of the golf ball. In one typical design, the outer surface of the golf ball is formed from at least one colored coated layer and/or at least one base coated layer, and at least one transparent coated layer is subsequently applied. The colored coated layer/the base coated layer and the transparent coated layer can be used to increase the aesthetics of the golf ball, and to shield or cover surface flaws resulting from a manufacturing process. The transparent coated layer is especially important because it protects any images such as trademarks, logos or other marks that can be placed on the outer surface of the golf ball. Aside from a logo of a golf ball manufacturer, a customized golf ball may have an image such as a logo of a university or company on an outer surface of the transparent coated layer.

SUMMARY OF THE DISCLOSURE

In response to the above-referenced technical inadequacies, the present disclosure provides a method for manufacturing a golf ball having a non-uniform dot pattern. Such a never-before-seen non-uniform dot pattern can increase the aesthetics and ornamentality of the golf ball, which allows the golf ball to be more appealing.

In one aspect, the present disclosure provides a method for manufacturing a golf ball having a non-uniform dot pattern, which includes: (a) providing a semi-finished product of the golf ball, and the semi-finished product of the golf ball includes a ball body and a base layer covering an outer surface of the ball body; and (b) rotating the semi-finished product of the golf ball at a predetermined rotation speed and applying a color paint to the semi-finished product of the golf ball from each of an upper position and a lower position in a spraying manner, so as to form the non-uniform dot pattern on the base layer.

In another aspect, the present disclosure provides a method for manufacturing a golf ball having a non-uniform dot pattern, which includes: (a) providing a first semi-finished product of the golf ball, and the first semi-finished product of the golf ball includes a ball body and a base layer covering an outer surface of the ball body; (b) rotating the first semi-finished product of the golf ball at a predetermined rotation speed and applying a first color paint to the first semi-finished product of the golf ball from each of an upper position and a lower position in a spraying manner, so as to form a first non-uniform dot pattern on the base layer, such that a second semi-finished product of the golf ball is obtained; and (c) rotating the second semi-finished product of the golf ball at another predetermined rotation speed and applying a second color paint from each of the upper position and the lower position in the spraying manner, so as to form a second non-uniform dot pattern on the base layer, and the second non-uniform dot pattern and the first non-uniform dot pattern are different in color from each other.

One of the beneficial effects of the subject matter provided by the present disclosure is that, the method for manufacturing a golf ball having a non-uniform dot pattern can allow the golf ball to have an appealing appearance showing a unique visual effect during its service life, by virtue of "applying one or two kinds of color paints from an upper position and a lower position in a spraying manner".

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
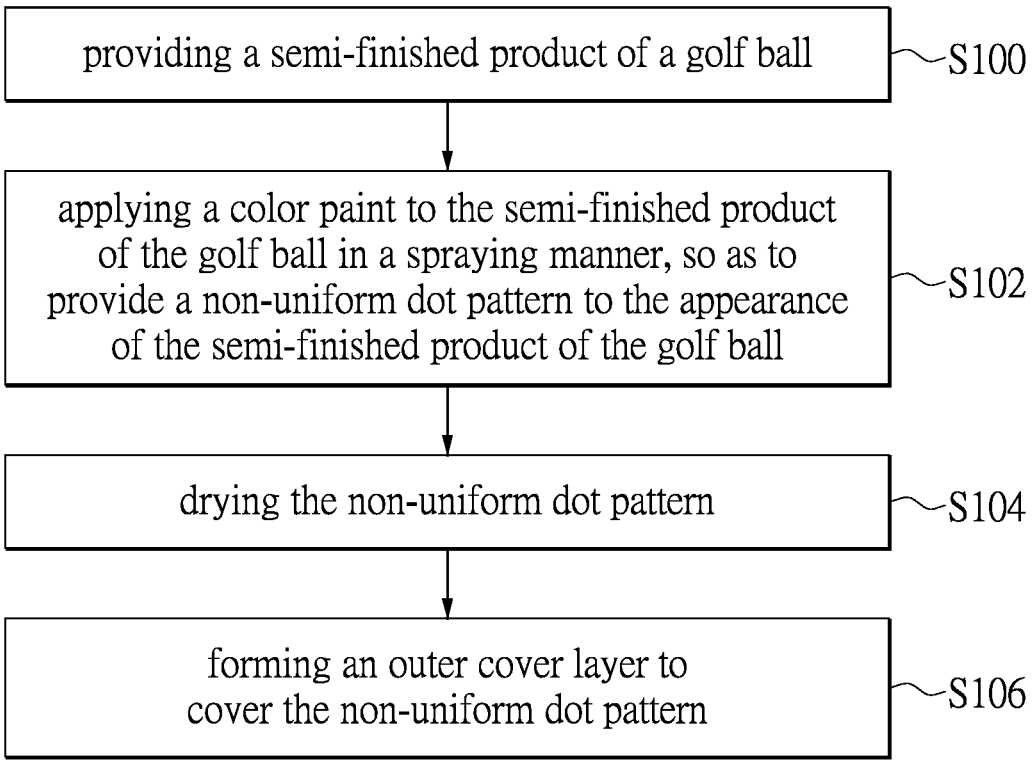
FIG. 1 is a flowchart of a method for manufacturing a golf ball having a non-uniform dot pattern according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

With the popularization of golf in recent years, the sport has attracted more and more players. When using a golf ball that matches a personal preference, a user can engage in practice or competition with a higher level of enjoyment. Therefore, various manufacturers have designed golf balls with myriad appearances, thus inspiring the development of a method of manufacturing a golf ball as provided by the present disclosure.

First Embodiment

Referring to FIG. 1, a first embodiment of the present disclosure provides a method for manufacturing a golf ball having a non-uniform dot pattern. The method mainly includes: step S100, providing a semi-finished product of a golf ball; and step S102, applying a color paint to the semi-finished product of the golf ball in a spraying manner, so as to provide a non-uniform dot pattern to the appearance of the semi-finished product of the golf ball.

Figure 2:
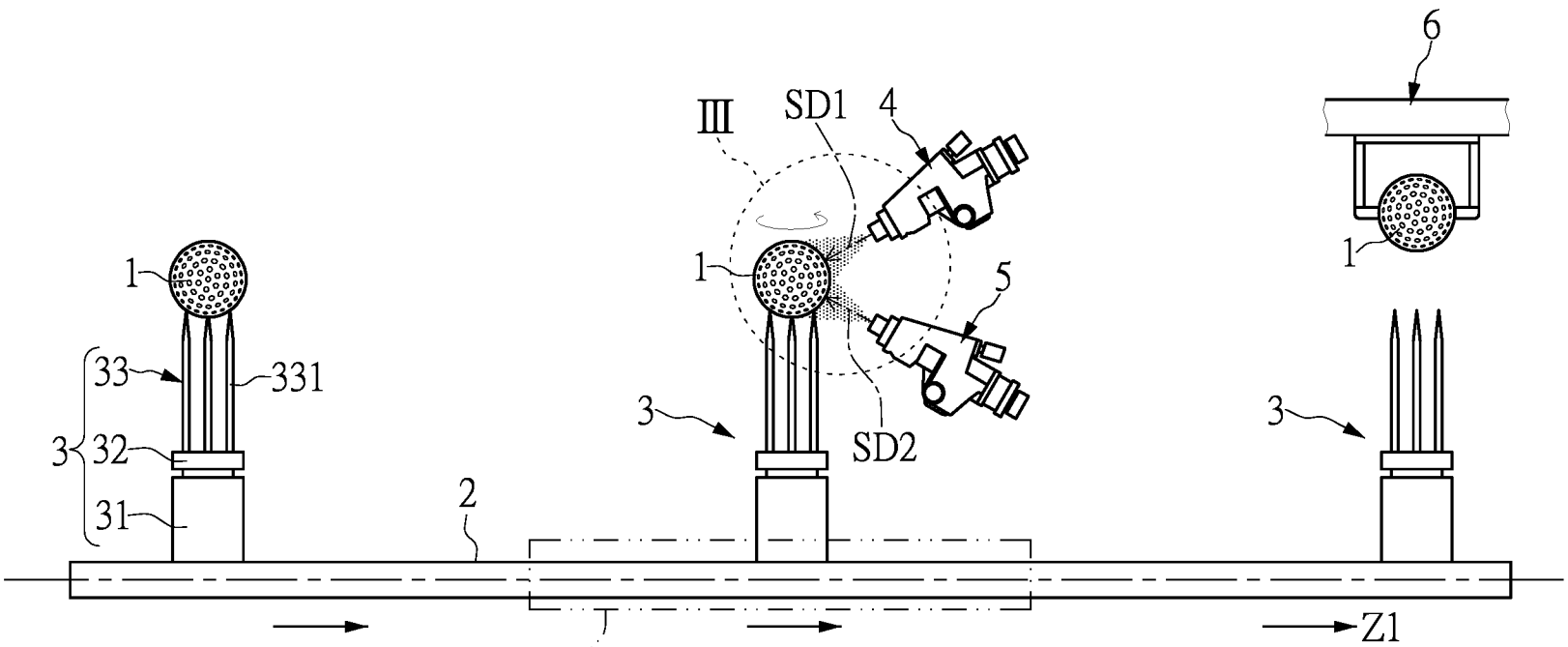
FIG. 2 is a schematic view showing a manufacturing process of the method according to the first embodiment of the present disclosure.
Figure 3:
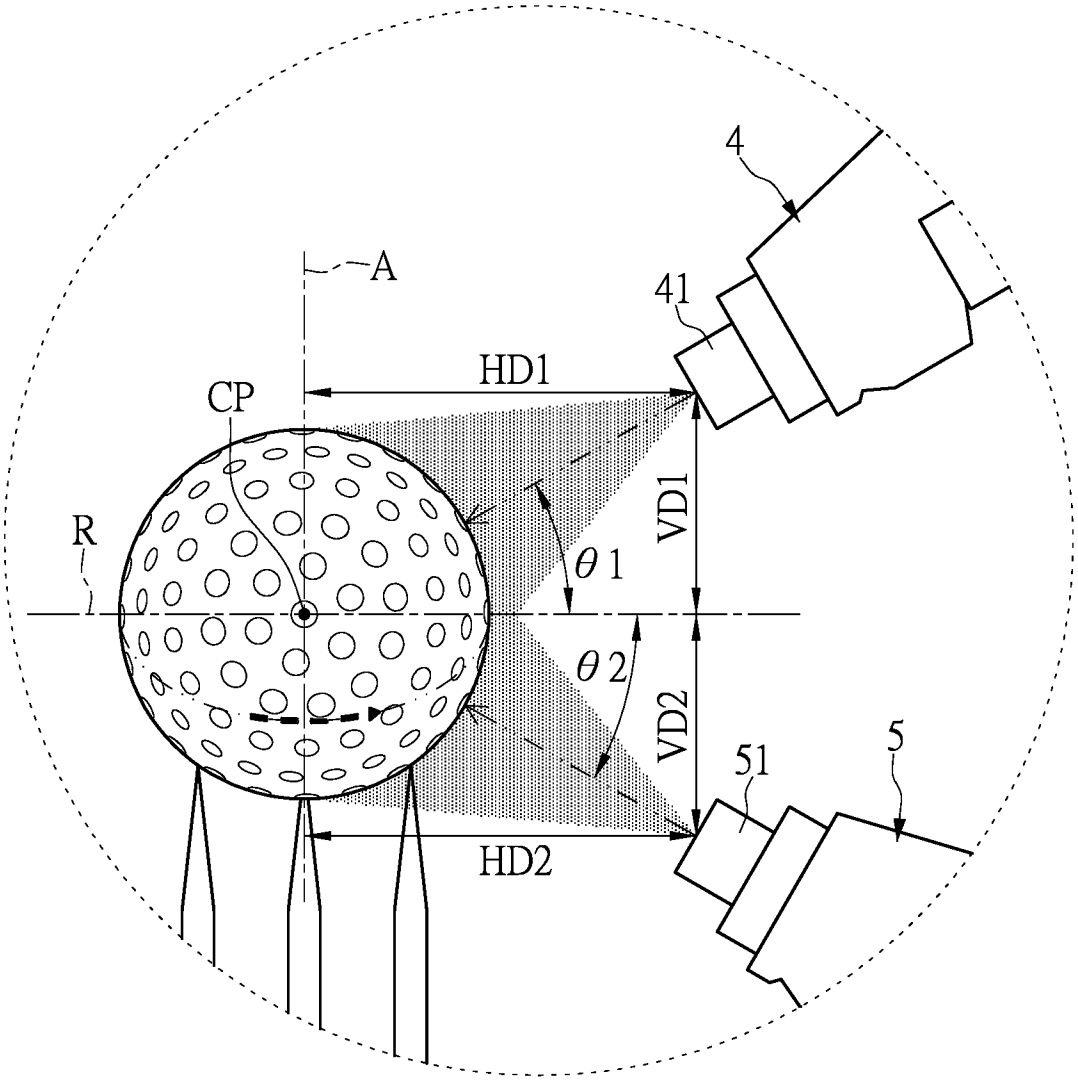
FIG. 3 is an enlarged view of part III of FIG. 2.

Reference is made to FIG. 2. In step S100, the semi-finished product 1 of the golf ball is moved into a processing area A1 along a planned path Z1, which is used for manufacturing an appearance pattern thereof. More specifically, the semi-finished product 1 of the golf ball is moved into the processing area A1 by a conveying device. The conveying device can include a first conveyor 2 configured to be parallel to a ground plane and at least one rotatable retainer 3 disposed on the first conveyor 2.

In use, the semi-finished product 1 of the golf ball can be retained by the rotatable retainer 3, such that a center point CP thereof is located at a predetermined height. The semi-finished product 1 of the golf ball defines a rotation axis A passing through the center point CP and a horizontal reference plane R perpendicular to the rotation axis A. If necessary, the semi-finished product 1 of the golf ball can be rotated at a predetermined rotation speed by the rotatable retainer 3. The rotatable retainer 3, together with the semi-finished product 1 of the golf ball, can be moved into the processing area A1 by the first conveyor 2.

In the present embodiment, the first conveyor 2 can be a belt conveyor. The rotatable retainer 3 can include a driving assembly 31, a platform 32 disposed on the driving assembly 31 and configured to be parallel to the first conveyor 2, and a first retaining element 33 disposed on the platform 32. The first retaining element 33 can include at least three pointed bodies 331 extending from the platform 32. The above description is only exemplary, and is not intended to limit the scope of the present disclosure.

Figure 4:
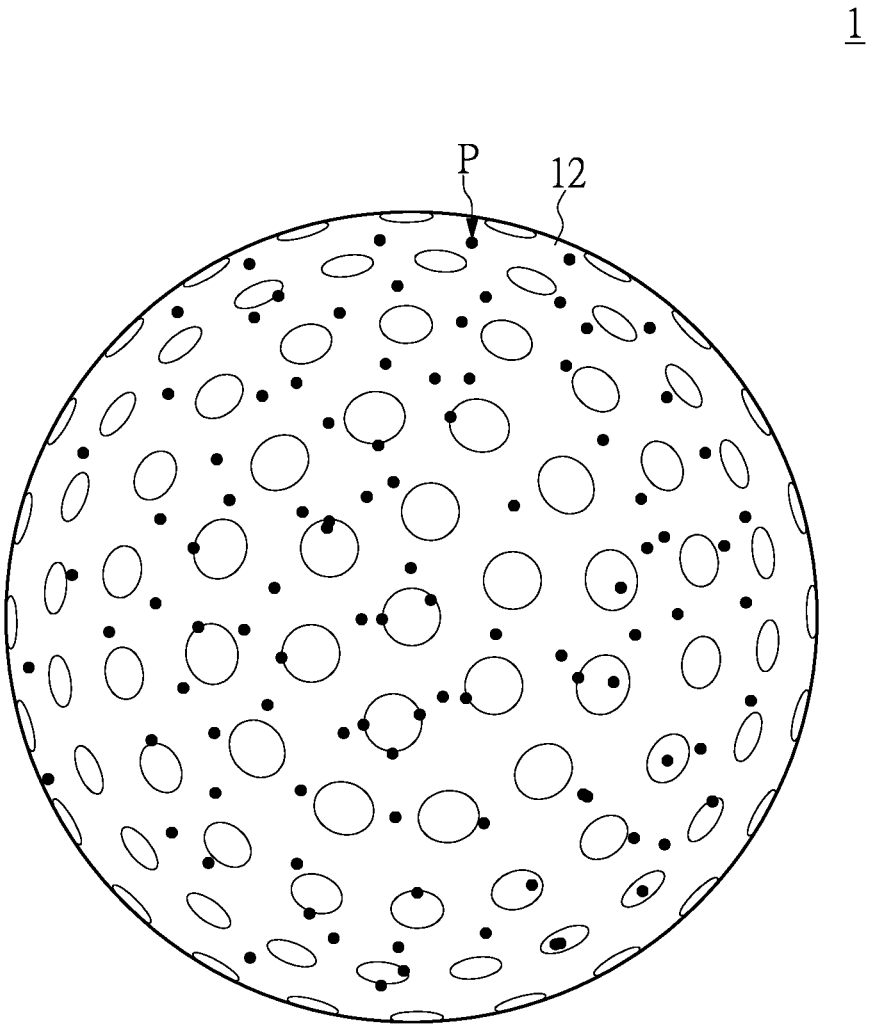
FIG. 4 is a schematic view showing an appearance of the golf ball manufactured by the method according to the first embodiment of the present disclosure.
Figure 5:
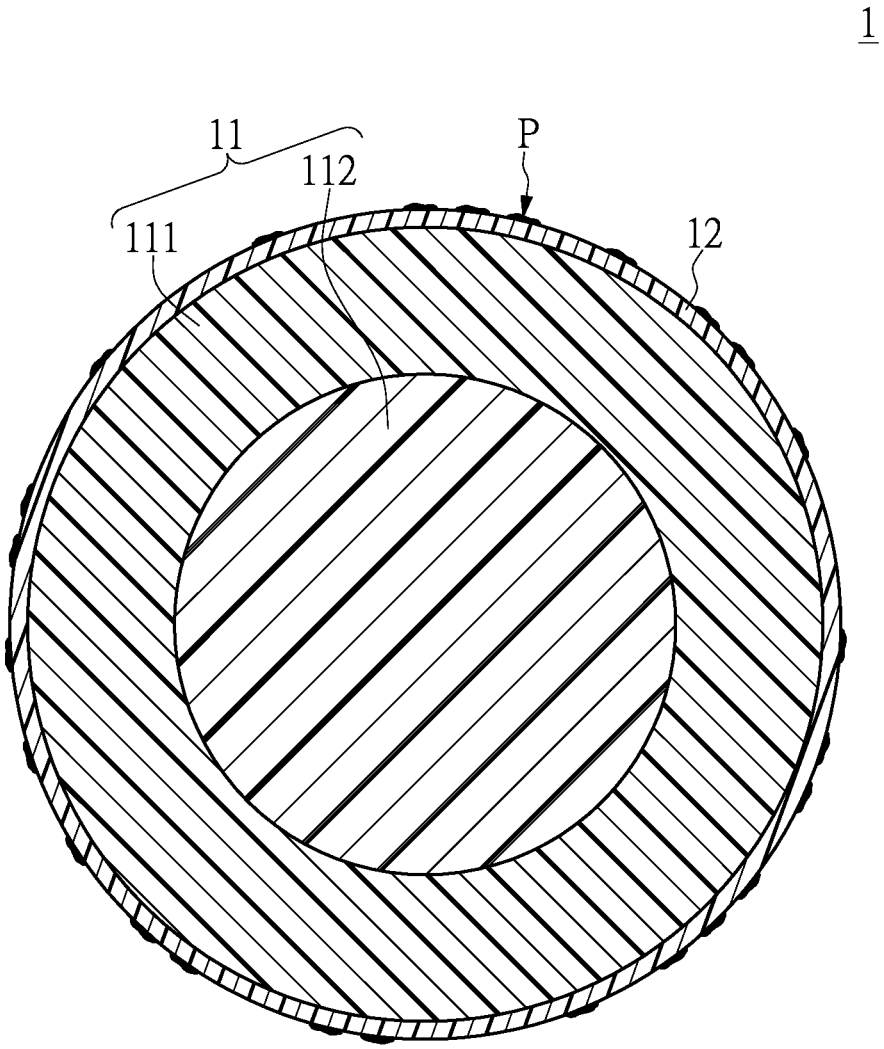
FIG. 5 is a cross-sectional view of the golf ball manufactured by the method according to the first embodiment of the present disclosure.

Reference is made to FIG. 4 and FIG. 5. The semi-finished product 1 of the golf ball can include a ball body 11 and a base layer 12 covering an outer surface 110 of the ball body 11. The ball body 11 can be a double-layered structure, which includes a ball core 111 and a ball shell 112 enclosing the ball core 111. The base layer 12 uniformly covers the entire outer surface 110 of the ball body 11. That is, a thickness of the base layer 12 on one point or area of the outer surface 110 is approximately the same as another thickness of the base layer 12 on another one point or area of the outer surface 110. The base layer 12 is mainly used to support and highlight a non-uniform dot pattern P, and in addition, it can be used to support an identification mark or sign (not shown). In certain embodiments, the ball body 11 can be a multi-layered structure, which further includes one or more mid layers (not shown) disposed between the ball core 111 and the ball shell 112.

In practice, the ball core 111 and the ball shell 112 can be formed of any suitable material. For example, the ball core 111 and the ball shell 112 are each a cured product of an ionomer, a polymer or a rubber component. Furthermore, the ball shell 112 can have a desired number of dimples with a desired shape, so as to reduce a gas drag effect on the golf ball during flight, thereby increasing the flight distance of the golf ball. In certain embodiments, the number of the dimples can be from 200 to 500, and preferably from 250 to 400. The shape of the dimples can be round or polygonal. The base layer 12 can have one or more base color layers such as white color layers. The base layer 12 can also have one or more base color layers and one or more outer color layers. The base color layer(s) and the outer color layer(s) show different colors. The above description is only exemplary, and is not intended to limit the scope of the present disclosure.

Reference is made to FIG. 2 to FIG. 5. In step S102, the semi-finished product 1 of the golf ball is rotated at a predetermined rotation speed, and two color paints are applied from an upper position and a lower position in a spraying manner, respectively, so as to form a non-uniform dot pattern P on the base layer 12. The non-uniform dot pattern P has pattern dots of a single color that is selected from original colors such as black, red, blue, purple, orange, yellow and green, any light color thereof, and any mixed color thereof. The upper position is above the horizontal reference plane R, and the lower position is below the horizontal reference plane R. The upper position is also an upper diagonal position of the semi-finished product 1 of the golf ball, and the lower position is also a lower diagonal position of the semi-finished product 1 of the golf ball.

More specifically, the semi-finished product 1 of the golf ball is driven by the rotatable retainer 3 to rotate around the rotation axis A, a rotation speed of which can be 300 rpm. While the semi-finished product 1 of the golf ball is rotating, the color paints can be simultaneously applied from the upper position and the lower position by a first sprayer 4 and a second sprayer 5, respectively. In order to improve the fineness of the non-uniform dot pattern P, the first sprayer 4 and the second sprayer 5 can be symmetrically arranged at upper and lower sides of the horizontal reference plane R, in which the first sprayer 4 is inclined downward and the second sprayer 5 is inclined upward.

It should be noted that, the color paint applied from the upper position is sprayed onto the base layer 12 along a first spray direction SD1 that is inclined downward at a predetermined angle θ1 relative to the horizontal reference plane R. The predetermined angle θ1 is from 20 degrees to 30 degrees. The color paint applied from the lower position is sprayed onto the base layer 12 along a second spray direction SD2 that is inclined upward at a predetermined angle θ2 relative to the horizontal reference plane. The predetermined angle θ2 is from 20 degrees to 30 degrees. Therefore, the method of the present disclosure has better economic benefits, and can allow the appearance of the golf ball to have a unique visual effect. Furthermore, each surface area of the base layer 12 can have non-uniformly distributed pattern dots thereon.

In practice, the color paints have a viscosity from 18 seconds to 22 seconds that is measured by a No. 4 Zahn cup and at a temperature from 24° C. to 25° C. The first sprayer 4 and the second sprayer 5 are each a pressure feed spray gun (model name: SGD-71/SGD-RA100/SGD-RA-200 available from Taiwan Prona Industries Co., Ltd.). Application conditions of the first sprayer 4 and the second sprayer 5 mainly include an atomization pressure of 1-3.5 $Kg/cm^2$. Furthermore, the first sprayer 4 has a first spraying head 41, and the second sprayer 5 has a second spraying head 51. The first sprayer 4 (the second sprayer 5) can spray a different type of fine dots by using a different kind of the first spraying head 41 (the second spraying head 51). It should be noted that, each of the first sprayer 4 and the second sprayer 5 has a self-cleaning function for removing residual color paint after being used for a period of time, thereby achieving a long-term normal and stable operation.

Based on the above application conditions, the first sprayer 4 can be configured such that the shortest horizontal distance HD1 between the first spraying head 41 and the center point CP of the semi-finished product 1 of the golf ball is from 10 cm to 25 cm, preferably from 12 cm to 20 cm, and that the shortest vertical distance VD1 between the first spraying head 41 and the horizontal reference plane R is from 4 cm to 10 cm, and preferably 6 cm. Similarly, the second sprayer 5 can be configured such that the shortest horizontal distance HD2 between the second spraying head 51 and the center point CP of the semi-finished product 1 of the golf ball is from 10 cm to 25 cm, preferably from 12 cm to 20 cm, and that the shortest vertical distance VD2 between the second spraying head 51 and the horizontal reference plane R is from 4 cm to 10 cm, and preferably 6 cm.

Figure 6:
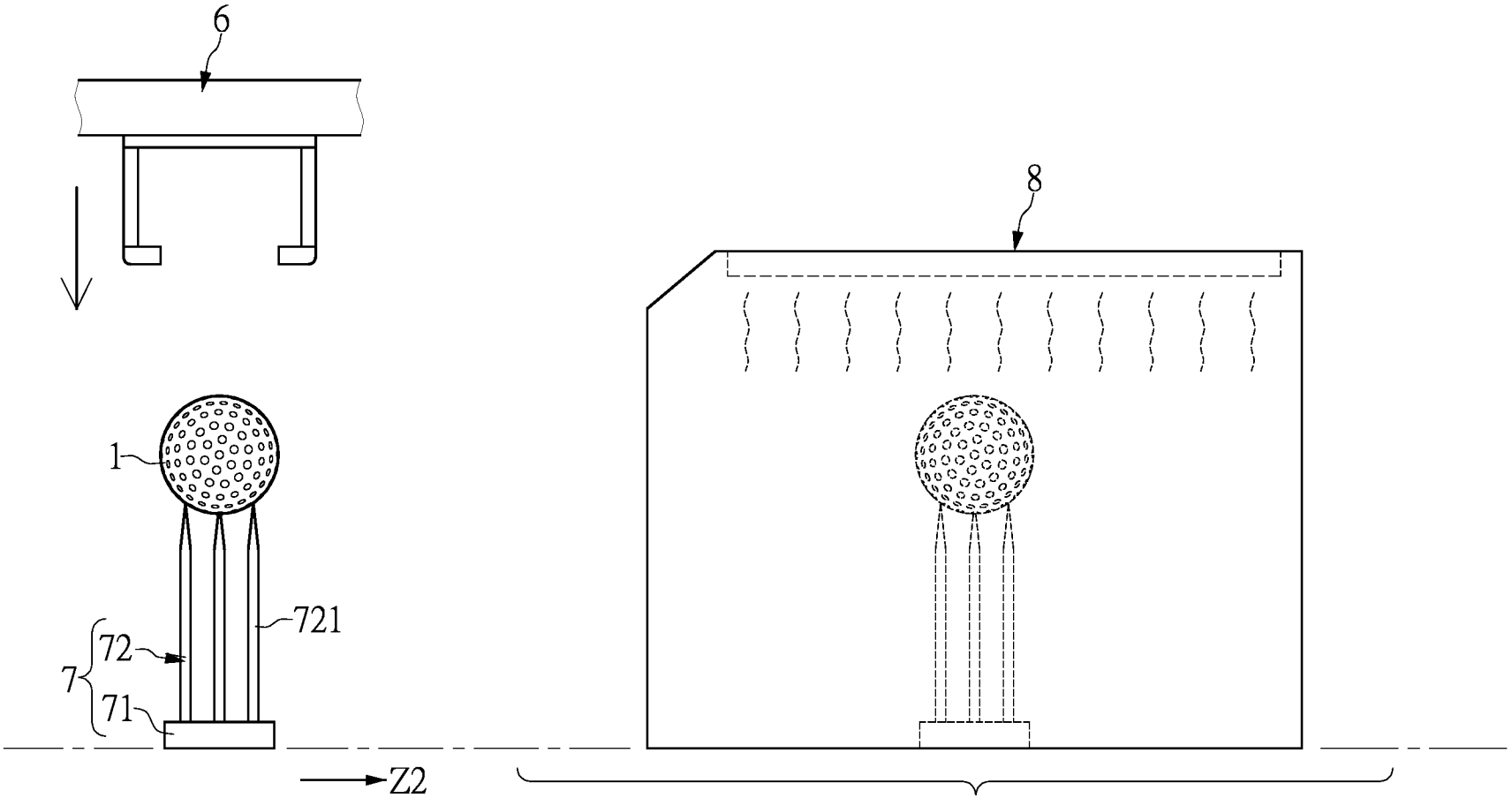
FIG. 6 is a schematic view showing another manufacturing process of the method according to the first embodiment of the present disclosure.

Reference is again made to FIG. 1, which is to be read in conjunction with FIG. 4 to FIG. 6. The method of the present disclosure can further include step S104, drying the non-uniform dot pattern, depending on particular implementations. In step S104, the color-paint-applied semi-finished product 1 of the golf ball is dried at a temperature from 50° C. to 60° C. for 20 minutes to 30 minutes, and is preferably dried at 55° C. for 24 minutes. Accordingly, the non-uniform dot pattern P is firmly adhered to the base layer 12. More specifically, the color-paint-applied semi-finished product 1 of the golf ball is transported by a gripper 6 to another processing area A2 that is separated from the processing area A1, and is then moved by a second conveyor 7 into an effective heating range of a heater 8 to be dried.

In the present embodiment, the second conveyor 7 can include at least a moving base 71 that has at least one second retaining element 72 disposed thereon. The at least one second retaining element 72 can include at least three pointed bodies 721 extending from the moving base 71. In use, the moving base 71 is configured to move the semi-finished product 1 of the golf ball along another planned path Z2. The at least one second retaining element 72 is configured to receive the semi-finished product 1 of the golf ball from the gripper 6, and to retain the semi-finished product 1 of the golf ball at a predetermined height, so as to enter the effective heating range of the heater 8. The above description is only exemplary, and is not intended to limit the scope of the present disclosure.

In addition, the method of the present disclosure can further include step S106, forming an outer cover layer to cover the non-uniform dot pattern. In step S106, the outer cover layer is formed in a continuous shape and covers an outer surface of the base layer 12 entirely. The outer cover layer can include one or more transparent coated layers. Accordingly, the durability of the golf ball can be increased, and the non-uniform dot pattern P can remain intact and clear during the service life of the golf ball.

Second Embodiment

Figure 7:
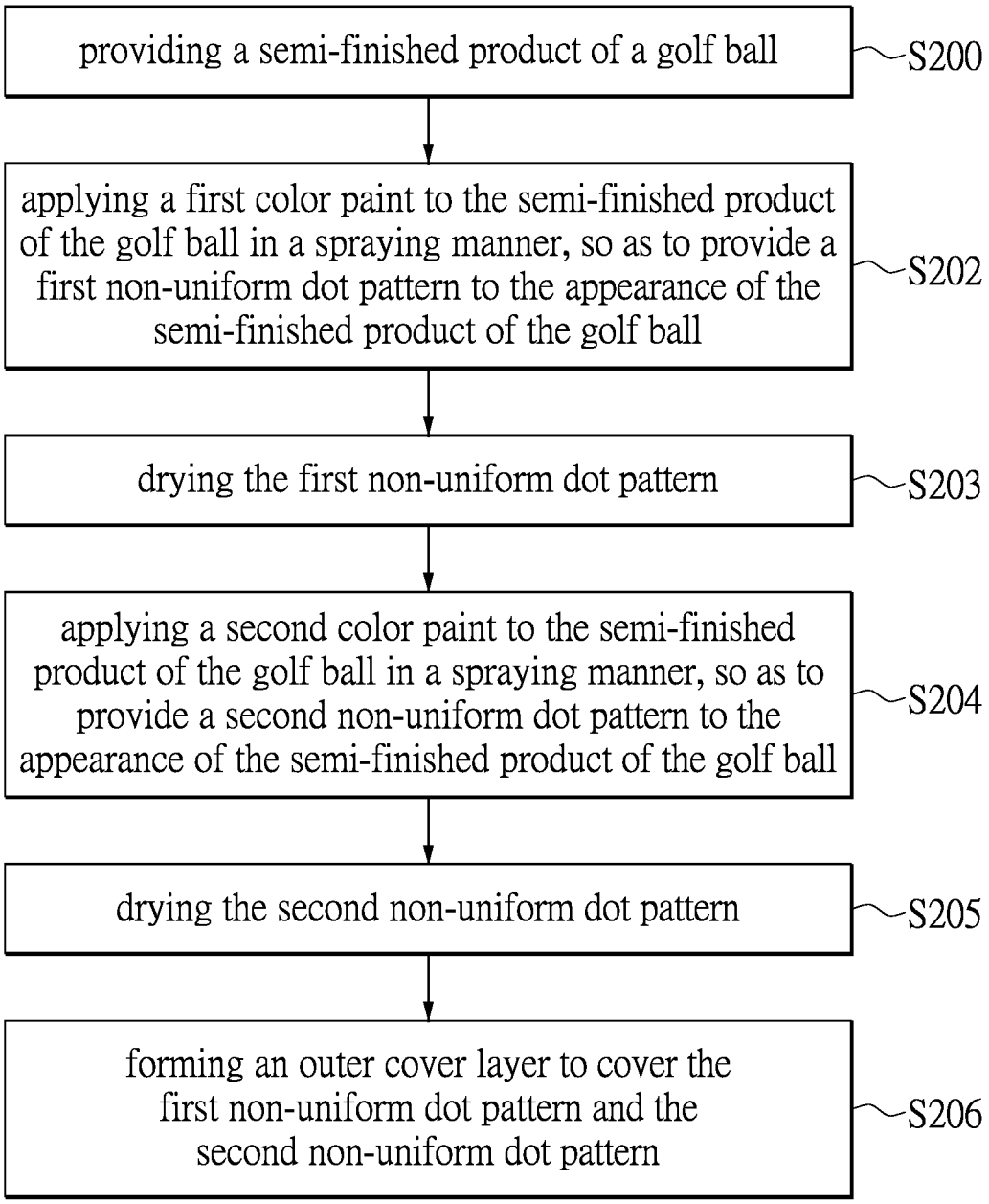
FIG. 7 is a flowchart of a method for manufacturing the golf ball having the non-uniform dot pattern according to a second embodiment of the present disclosure.
Figure 8:
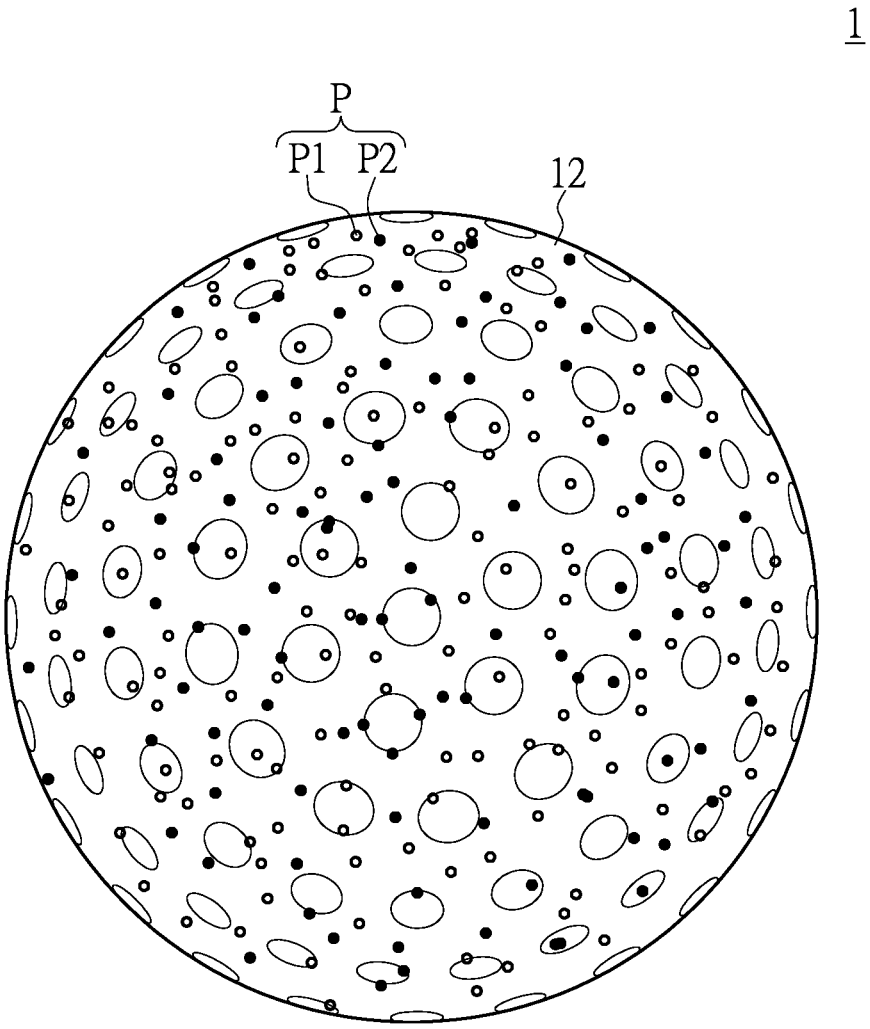
FIG. 8 is a schematic view showing an appearance of the golf ball manufactured by the method according to the second embodiment of the present disclosure.

Referring to FIG. 7, a second embodiment of the present disclosure provides a method for manufacturing a golf ball having a non-uniform dot pattern. The method mainly includes: step S200, providing a semi-finished product of a golf ball; step S202, applying a first color paint to the semi-finished product of the golf ball in a spraying manner, so as to provide a first non-uniform dot pattern to the appearance of the semi-finished product of the golf ball; and step S204, applying a second color paint to the semi-finished product of the golf ball in a spraying manner, so as to provide a second non-uniform dot pattern to the appearance of the semi-finished product of the golf ball.

Figure 9:
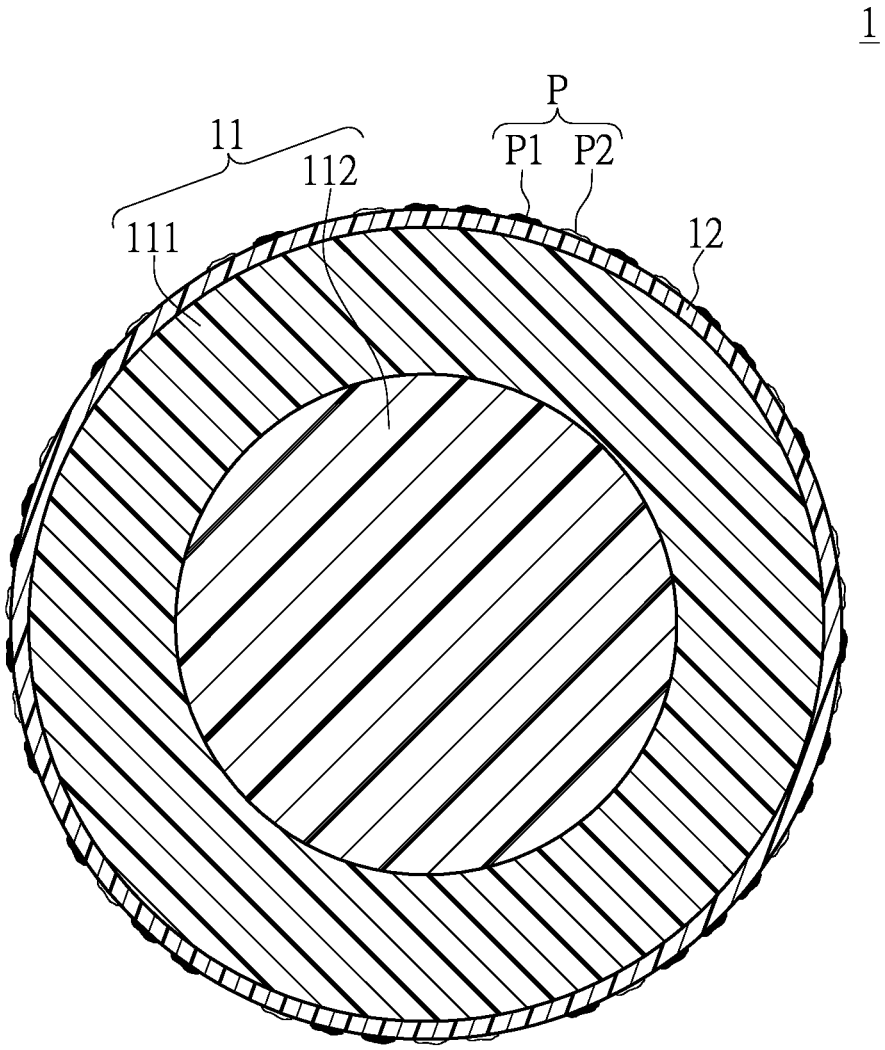
FIG. 9 is a cross-sectional view of the golf ball manufactured by the method according to the second embodiment of the present disclosure.

Reference is made to FIG. 2, FIG. 4, FIG. 8, and FIG. 9. In step S200, the semi-finished product 1 of the golf ball is moved into a processing area A1 along a planned path Z1, which is for the manufacturing of an appearance pattern. More specifically, the semi-finished product 1 of the golf ball is moved into the processing area A1 by a conveying device. The technical details of the conveying device are described in the first embodiment, and will not be reiterated herein. As shown in FIG. 9, the golf ball can include a ball body 11 and a base layer 12 covering an outer surface 110 of the ball body 11. The technical details of the ball body 11 and the base layer 12 are described in the first embodiment, and will not be reiterated herein.

In step S202, the semi-finished product 1 of the golf ball is rotated at a predetermined rotation speed, and two first color paints are applied from an upper position and a lower position in a spraying manner, respectively, so as to form a first non-uniform dot pattern P1 on the base layer 12. The first non-uniform dot pattern P1 has pattern dots of a single color that is selected from original colors such as black, red, blue, purple, orange, yellow and green, any light color thereof, and any mixed color thereof. In the process of applying the first color paints, the semi-finished product 1 of the golf ball is retained at a predetermined height by the rotatable retainer 3, and the semi-finished product 1 of the golf ball defines a rotation axis A passing through a center point CP and a horizontal reference plane R perpendicular to the rotation axis A. The semi-finished product 1 of the golf ball is driven by the rotatable retainer 3 to rotate around the rotation axis A, a rotation speed of which can be 300 rpm. The upper position is above the horizontal reference plane R, and the lower position is below the horizontal reference plane R. The upper position is also an upper diagonal position of the semi-finished product 1 of the golf ball, and the lower position is also a lower diagonal position of the semi-finished product 1 of the golf ball.

More specifically, the first color paints can be simultaneously applied from the upper position and the lower position by a first sprayer 4 and a second sprayer 5, respectively. In order to improve the fineness of the first non-uniform dot pattern P1, the first sprayer 4 and the second sprayer 5 can be symmetrically arranged at upper and lower sides of the horizontal reference plane R, in which the first sprayer 4 is inclined downward and the second sprayer 5 is inclined upward.

It should be noted that, the first color paint applied from the upper position is sprayed onto the base layer 12 along a first spray direction SD1 that is inclined downward at a predetermined angle θ1 relative to the horizontal reference plane R. The predetermined angle θ1 is from 20 degrees to 30 degrees. The first color paint applied from the lower position is sprayed onto the base layer 12 along a second spray direction SD2 that is inclined upward at a predetermined angle θ2 relative to the horizontal reference plane. The predetermined angle θ2 is from 20 degrees to 30 degrees.

Reference is again made to FIG. 7, which is to be read in conjunction with FIG. 4 to FIG. 6. The method of the present disclosure can further include step S203, drying the first non-uniform dot pattern, depending on particular implementations. In step S203, the first-color-paint-applied semi-finished product 1 of the golf ball is dried at a temperature from 50° C. to 60° C. for 20 minutes to 30 minutes, and is preferably dried at 55° C. for 24 minutes. Accordingly, the first non-uniform dot pattern P1 is firmly adhered to the base layer 12. The implementation details of step S203, i.e., the first-color-paint-applied semi-finished product 1 of the golf ball can be moved into an effective heating range of a heater 8 by a gripper 6 and a second conveyor 7 to be dried, are described in the first embodiment, and will not be reiterated herein.

In step S204, the first-color-paint-applied semi-finished product 1 of the golf ball is rotated at a predetermined rotation speed, and two second color paints are applied from an upper position and a lower position in a spraying manner, respectively, so as to form a second non-uniform dot pattern P2 on the base layer 12. The second non-uniform dot pattern P2 has pattern dots of another color that is selected from original colors such as black, red, blue, purple, orange, yellow and green, any light color thereof, and any mixed color thereof. The upper position and the lower position for applying the second color paints in step S204 are the same as those for applying the first color paints in step S202.

In the present disclosure, the second non-uniform dot pattern P2 can be partially overlapped with the first non-uniform dot pattern P1. The pattern dots of the second non-uniform dot pattern P2 and the pattern dots of the first non-uniform dot pattern P1 are different in color from each other. In consideration of the effect of color matching or color contrast, the first non-uniform dot pattern P1 and the second non-uniform dot pattern P2 can respectively be an advancing color and a receding color. Therefore, the appearance of the golf ball can have a fine layer-by-layer effect so as to better attract attention.

More specifically, the first-color-paint-applied semi-finished product 1 of the golf ball is driven by the rotatable retainer 3 to rotate around the rotation axis A, a rotation speed of which can be 300 rpm. While the first-color-paint-applied semi-finished product 1 of the golf ball is rotating, the second color paints can be simultaneously applied from the upper position and the lower position by the first sprayer 4 and the second sprayer 5, respectively. In order to improve the fineness of the second non-uniform dot pattern P2, the first sprayer 4 and the second sprayer 5 can be symmetrically arranged at the upper and lower sides of the horizontal reference plane R, in which the first sprayer 4 is inclined downward and the second sprayer 5 is inclined upward. Similarly, the second color paint applied from the upper position is sprayed onto the base layer 12 along the first spray direction SD1, and the second color paint applied from the lower position is sprayed onto the base layer 12 along the second spray direction SD2.

In practice, the first color paint and the second color paint have a viscosity from 18 seconds to 22 seconds that is measured by a No. 4 Zahn cup and at a temperature from 24° C. to 25° C. The first sprayer 4 and the second sprayer 5 are each a pressure feed spray gun (model name: SGD-71/SGD-RA100/SGD-RA-200 available from Taiwan Prona Industries Co., Ltd.). Application conditions of the first sprayer 4 and the second sprayer 5 mainly include an atomization pressure of 1-3.5 $Kg/cm^2$. Furthermore, the first sprayer 4 has a first spraying head 41, and the second sprayer 5 has a second spraying head 51. The first sprayer 4 (or the second sprayer 5) can spray different types of fine dots by using different kinds of the first spraying head 41 (or the second spraying head 51). It should be noted that, each of the first sprayer 4 and the second sprayer 5 has a self-cleaning function for removing residual color paint after being used for a period of time, thereby achieving a long-term normal and stable operation.

Based on the above application conditions, the first sprayer 4 can be configured such that the shortest horizontal distance HD1 between the first spraying head 41 and the center point CP is from 10 cm to 25 cm, preferably from 12 cm to 20 cm, and that the shortest vertical distance VD1 between the first spraying head 41 and the horizontal reference plane R is from 4 cm to 10 cm, and preferably 6 cm. Similarly, the second sprayer 5 can be configured such that the shortest horizontal distance HD2 between the second spraying head 51 and the center point CP is from 10 cm to 25 cm, preferably from 12 cm to 20 cm, and that the shortest vertical distance VD2 between the second spraying head 51 and the horizontal reference plane R is from 4 cm to 10 cm, and preferably 6 cm.

Reference is again made to FIG. 7, which is to be read in conjunction with FIG. 6. The method of the present disclosure can further include step S205, drying the second non-uniform dot pattern, depending on particular implementations. In step S205, the second-color-paint-applied semi-finished product 1 of the golf ball is dried at a temperature from 50° C. to 60° C. for 20 minutes to 30 minutes, and is preferably dried at 55° C. for 24 minutes. Accordingly, the second non-uniform dot pattern P2 is firmly adhered to the base layer 12. The implementation details of step S205, i.e., the second-color-paint-applied semi-finished product 1 of the golf ball can be moved into the effective heating range of the heater 8 by a gripper 6 and a second conveyor 7 to be dried, are described in the first embodiment, and will not be reiterated herein.

In addition, the method of the present disclosure can further include step S206, forming an outer cover layer to cover the first non-uniform dot pattern and the second non-uniform dot pattern. In step S206, the outer cover layer is formed in a continuous shape and covers an outer surface of the base layer 12 entirely. The technical details of the outer cover layer are described in the first embodiment, and will not be reiterated herein. Accordingly, the durability of the golf ball can be increased, and the first and second non-uniform dot pattern P1, P2 can remain intact and clear during the service life of the golf ball.

Beneficial Effects of the Embodiments

The method for manufacturing a golf ball having a non-uniform dot pattern of the present disclosure can allow the golf ball to have an appealing appearance showing a unique visual effect during its service life, by virtue of "applying one or two kinds of color paints from an upper position and a lower position in a spraying manner".

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A method for manufacturing a golf ball, comprising the following steps:

(a) providing a semi-finished product of the golf ball, wherein the semi-finished product of the golf ball includes a ball body and a base layer covering an outer surface of the ball body;

(b) rotating the semi-finished product of the golf ball at a predetermined rotation speed, and applying a color paint to the semi-finished product of the golf ball from each of an upper position and a lower position in a spraying manner, so as to form a plurality of dots nonuniformly distributed on the base layer, wherein at least two of the plurality of dots have a partial overlap; and (c) conducting a self-cleaning process of each of the first sprayer and the second sprayer after the first sprayer and the second sprayer are used for a period of time;

wherein in step (a), the semi-finished product of the golf ball is retained at a predetermined height and defines a horizontal reference plane, and the semi-finished product of the golf ball is divided into two half portions by the horizontal reference plane; wherein the upper position is above the horizontal reference plane and the lower position is below the horizontal reference plane;

wherein in step (b), a first sprayer is used to apply, from the upper position, the corresponding color paint which has a viscosity from 18 seconds to 22 seconds measured by a No. 4 Zahn cup and at a temperature from 24° C. to 25° C., under an atomization pressure of 1-3.5 $kg/cm^2$; wherein a second sprayer is used to apply, from the lower position, the corresponding color paint which has a viscosity from 18 seconds to 22 seconds measured by the No. 4 Zahn cup and at a temperature from 24° C. to 25° C., under an atomization pressure of 1-3.5 $kg/cm^2$; wherein the corresponding color paint applied from the upper position is sprayed onto the base layer along a first spray direction, which is inclined downward at an angle from 20 degrees to 30 degrees relative to the horizontal reference plane, and the corresponding color paint applied from the lower position is sprayed onto the base layer along a second spray direction, which is inclined upward at an angle from 20 degrees to 30 degrees relative to the horizontal reference plane;

wherein the first sprayer has a first spraying head, a shortest horizontal distance between the first spraying head and a center point of the semi-finished product of the golf ball is from 10 cm to 25 cm, and a shortest vertical distance between the first spraying head and the horizontal reference plane is from 4 cm to 10 cm; wherein the second sprayer has a second spraying head, a shortest horizontal distance between the second spraying head and the center point of the semi-finished product of the golf ball is from 10 cm to 25 cm, and a shortest vertical distance between the second spraying head and the horizontal reference plane is from 4 cm to 10 cm.

2. The method according to claim 1, further comprising a step of forming an outer cover layer on the base layer to cover the plurality of dots.

3. A method for manufacturing a golf ball, comprising:

(a) providing a first semi-finished product of the golf ball, wherein the first semi-finished product of the golf ball includes a ball body and a base layer covering an outer surface of the ball body;

(b) rotating the first semi-finished product of the golf ball at a predetermined rotation speed, applying a first color paint to the first semi-finished product of the golf ball from each of an upper position and a lower position in a spraying manner, so as to form a plurality of first dots nonuniformly distributed on the base layer, such that a second semi-finished product of the golf ball is obtained;

(c) rotating the second semi-finished product of the golf ball at another predetermined rotation speed, and applying a second color paint to the second semi-finished product of the golf ball from each of the upper position and the lower position in the spraying manner, so as to form a plurality of second dots nonuniformly distributed on the base layer, wherein the plurality of first dots and the plurality of second dots are different in color from each other, and at least two dots of the plurality of first dots and/or the plurality of second dots have a partial overlap; and (d) conducting a self-cleaning process of each of the first sprayer and the second sprayer after the first sprayer and the second sprayer are used for a period of time;

wherein in step (a), the semi-finished product of the golf ball is retained at a predetermined height and defines a horizontal reference plane, and the semi-finished product of the golf ball is divided into two half portions by the horizontal reference plane; wherein the upper position is above the horizontal reference plane and the lower position is below the horizontal reference plane;

wherein in step (b), a first sprayer is used to apply, from the upper position, the corresponding first color paint which has a viscosity from 18 seconds to 22 seconds measured by a No. 4 Zahn cup and at a temperature from 24° C. to 25° C., under an atomization pressure of 1-3.5 kg/cm$^2$; wherein a second sprayer is used to apply, from the lower position, the corresponding first color paint which has a viscosity from 18 seconds to 22 seconds measured by the No. 4 Zahn cup and at a temperature from 24° C. to 25° C., under an atomization pressure of 1-3.5 kg/cm$^2$; wherein the corresponding first color paint applied from the upper position is sprayed onto the base layer along a first spray direction, which is inclined downward at an angle from 20 degrees to 30 degrees relative to the horizontal reference plane, and the corresponding first color paint applied from the lower position is sprayed onto the base layer along a second spray direction, which is inclined upward at an angle from 20 degrees to 30 degrees relative to the horizontal reference plane;

wherein in step (c), the first sprayer is used to apply, from the upper position, the corresponding second color paint which has a viscosity from 18 seconds to 22 seconds measured by the No. 4 Zahn cup and at a temperature from 24° C. to 25° C., under an atomization pressure of 1-3.5 kg/cm$^2$; wherein the second sprayer is used to apply, from the lower position, the corresponding second color paint which has a viscosity from 18 seconds to 22 seconds measured by the No. 4 Zahn cup and at a temperature from 24° C. to 25° C., under an atomization pressure of 1-3.5 kg/cm$^2$; wherein the corresponding second color paint applied from the upper position is sprayed onto the base layer along the first spray direction, and the corresponding second color paint applied from the lower position is sprayed onto the base layer along the second spray direction;

wherein the first sprayer has a first spraying head, a shortest horizontal distance between the first spraying head and a center point of the semi-finished product of the golf ball is from 10 cm to 25 cm, and a shortest vertical distance between the first spraying head and the horizontal reference plane is from 4 cm to 10 cm; wherein the second sprayer has a second spraying head, a shortest horizontal distance between the second spraying head and the center point of the semi-finished product of the golf ball is from 10 cm to 25 cm, and a shortest vertical distance between the second spraying head and the horizontal reference plane is from 4 cm to 10 cm.

4. The method according to claim 3, further comprising a step of forming an outer cover layer on the base layer to cover plurality of first dots and the plurality of second dots.

* * * * *